United States Patent [19]

Pfeiffer

[11] Patent Number: 4,949,606

[45] Date of Patent: Aug. 21, 1990

[54] APPARATUS FOR SEVERING DATA-BEARING TAPES WHICH ARE DISPENSED BY A MACHINE

[75] Inventor: Horst Pfeiffer, Aldingen, Fed. Rep. of Germany

[73] Assignee: Hengstler GmbH, Aldingen, Fed. Rep. of Germany

[21] Appl. No.: 275,528

[22] Filed: Nov. 22, 1988

[30] Foreign Application Priority Data

Dec. 5, 1987 [DE] Fed. Rep. of Germany ... 8716108[U]

[51] Int. Cl.[5] ..... B26D 1/62; B26D 5/06

[52] U.S. Cl. ..... 83/69; 83/334; 83/342; 83/349; 83/596; 83/672; 83/673; 83/860

[58] Field of Search ..... 83/341, 342, 349, 335, 83/355, 356.3, 672, 673, 674, 596, 859, 860, 69, 72

[56] References Cited

U.S. PATENT DOCUMENTS

| | | | |
|---|---|---|---|
| 1,053,912 | 2/1913 | Hamilton | 83/335 X |
| 2,233,490 | 3/1941 | Shields | 83/69 X |
| 3,868,878 | 3/1975 | Peak | 83/356.3 |
| 4,114,491 | 9/1978 | Hashimoto et al. | 83/349 X |
| 4,244,251 | 1/1981 | Iwao et al. | 83/349 |
| 4,422,358 | 12/1983 | Hull | 83/349 X |
| 4,664,006 | 5/1987 | Mitchell | 83/349 X |

FOREIGN PATENT DOCUMENTS

| | | | |
|---|---|---|---|
| 1302341 | 10/1961 | France | 83/342 |

*Primary Examiner*—Frank T. Yost
*Assistant Examiner*—Rinaldi Rada
*Attorney, Agent, or Firm*—Balogh, Osann, Kramer, Dvorak, Genova & Traub

[57] ABSTRACT

An apparatus for severing data-bearing tapes which are dispensed by a machine, which apparatus comprises an electric motor for driving a double-edged helical rotary cutter for cooperating with a spring-loaded stationary cutter, comprises an angle-section carrier, which is formed on the outside of one leg of said carrier with a concave recess extending along said one leg and receiving said rotary cutter, whereas the second leg of the carrier constitutes a bottom for mounting the motor, which is disposed in the spaced defined between the two legs, and the carrier is adapted to be cut to a length which matches the width of the tape to be severed.

14 Claims, 1 Drawing Sheet

APPARATUS FOR SEVERING DATA-BEARING TAPES WHICH ARE DISPENSED BY A MACHINE

BACKGROUND OF THE INVENTION

1. Field of the Invention

This invention relates to an apparatus for severing data-bearing tapes which are dispensed by a machine and which may consist of paper, cardboard or plastic tapes which have been wound to form a supply roll.

2. Description of the Prior Art

Known apparatus for severing data-bearing tapes which are dispensed by a machine are provided with an electric motor drive for driving a double-edged helical rotary cutter cooperating with a spring-biased stationary cutter. Such an apparatus is disclosed, e.g., is German Utility Model 84 10 627.

Such apparatuses are used in automatic plants which include integrated data printers for preparing and issuing documents, such as tickets for transportation, admission tickets, receipts and the like. The printed document must be severed, as a rule, from the supply roll of the data-bearing tape and this can be effected by so-called severing apparatuses.

SUMMARY OF THE INVENTION

It is an object of the invention to provide such a severing apparatus which is as small as possible so that it can be arranged as close as possible to the data printer.

It is another object of the invention to provide such a severing apparatus the operation of which is initiated in a manner which is simple and inexpensive, e.g., in response to a start pulse, and the operation of which is automatically performed.

It is a further object of the invention to provide for use with data-bearing tapes which differ in width.

In an apparatus for severing data-bearing tapes which are dispensed by a machine, which apparatus comprises an electric motor for driving a double-edged helical rotary cutter for cooperating with a spring-loaded stationary cutter, the objects set forth hereinbefore are accomlished in that the apparatus comprises an angle-section carrier, which is formed on the outside of one leg of said carrier with a concave recess extending along said one leg and receiving said rotary cutter, whereas the second leg of the carrier constitutes a bottom for mounting the motor, which is disposed in the space defined between the two legs.

Specifically, a relatively shallow, angular covering hood having the shape of a relatively flat angle is adapted to be mounted on that leg of the carrier which is formed with the concave recess receiving the rotary cutter, an angular covering hood for covering the electric motor is adapted to be mounted on the other leg of the carrier.

DETAILED DESCRIPTION OF THE PREFERRED EMBODIMENT

Figure 1:
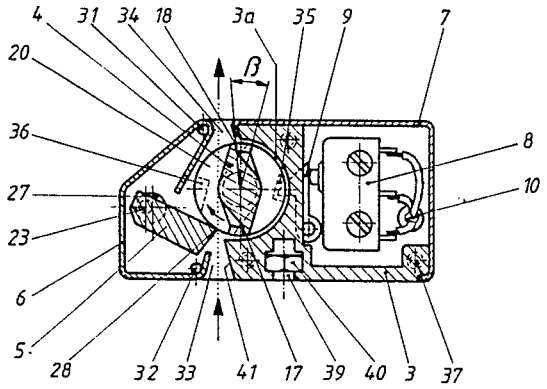
FIG. 1 is a transverse sectional view showing an illustrative embodiment of the invention.
Figure 2:
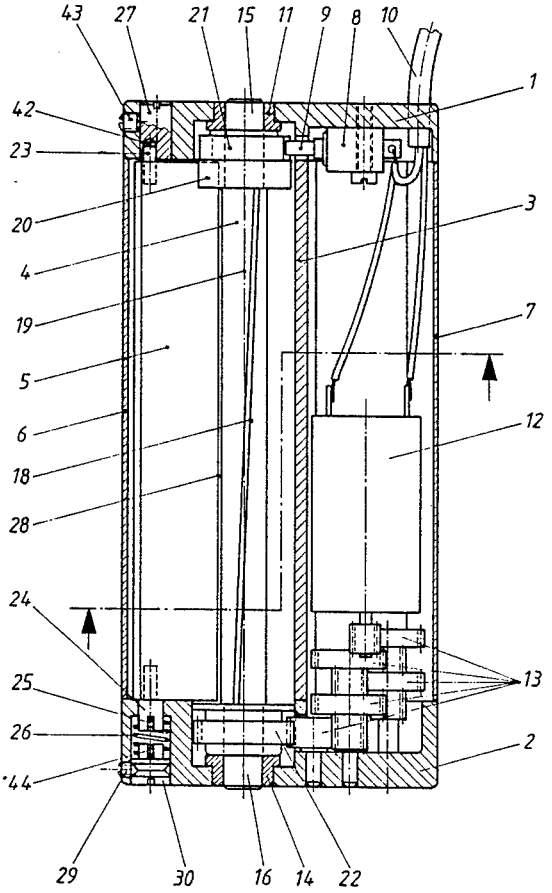
FIG. 2 is a horizontal sectional view showing the apparatus viewed from above.
Figure 3:
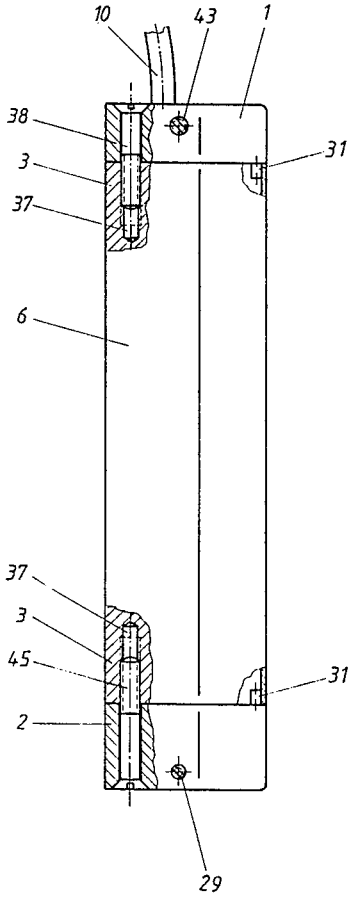
FIG. 3 is a side elevation showing the apparatus partly broken away.

An embodiment of the invention will now be described more in detail with reference to the drawing.

It is apparent from the drawing that the apparatus comprises two end walls 1 and 2, which are mounted at opposite ends of an angle-section carrier 3. One leg of the carrier 3 is formed with a concave recess 3a, which receives a double-edged helical rotary cutter 4, which cooperates with an adjustable stationary cutter 5, which is spring-urged against the rotary cutter 4. The angle carrier 3 is covered on opposite sides by covering hoods 6 and 7.

This is permitted in that the carrier 3, the rotary cutter 4, the fixed cutter 5, and the covering hoods 6 and 7 extend in a first longitudinal direction beyond an electric motor 12, which will be described hereinafter the electric motor 12 is mounted on the other leg of the carrier 3.

The carrier 3 is formed in opposite end faces with tapped bores 37. The end wall 1 is secured to one end of the carrier 3 by a screw 38 screwed into a bore 37 and is provided on the inside with a change-over switch 8, a follower lever 9, a control lead 10 and a bearing 11. The end wall 2 is mounted on the other end of the carrier 3 by means of a screw 45 screwed into the tapped bore 37 and is provided with an electric motor 12, which is connected to a multi-stage transmission 13, and a bearing 14. The carrier 3 is formed with a longitudinal groove 39 for receiving nuts 40 for securing the severing apparatus, e.g., to a data printer.

The double-edged helical rotary cutter 4 is made from a profiled steel bar and is integrally formed with two stub shafts 15 and 16. The rotary cutter is formed with two knife edges 17 and 18, which extend helically around the center line 19 of the profiled bar. One stub shaft 15 carries a guide ring 20 and a camwheel 21, which is formed with two notches 35, 36. A gear 22 is mounted on the other stub shaft 16. By means of the end portions of the stub shafts 15 and 16 the rotary cutter 4 is rotatably mounted in the bearings 11 and 14 provided in the end walls 1 and 2.

The stationary cutter 5, which is spring-urged against the rotary cutter 4, also consists of a profiled bar and is provided at both ends with inserted retaining pins 23 and 24. The pin 24 is formed with a slot 25 for receiving one end of a helical torsion spring 26. The pin 23 is mounted on an eccentric 27, which is rotatably mounted in the end wall 1. The eccentric can be manually adjusted to a position in which the knife edge 28 of the stationary cutter 5 is oblique to the center line 19 of the doulbe-edged rotary cutter 4 in such a manner that the knife edge 28 is spaced a larger distance from the center line 19 of the rotary cutter 4 on the side on which the guide ring 20 is provided than on the opposite side so that a drawing cut will be effected.

The second pin 24 of the stationary cutter 5 is formed with a slot 25 and is received by the end wall 2. A helical torsion spring 26 has one end that is received by the slot 25. The torsion spring 26 is prestressed by means of a spring-retaining member 30, which is adapted to be fixed in position by a clamp screw 29. The torsion spring urges the knife edge 28 of the stationary cutter against the guide ring 20 when the apparatus is at a standstill and resiliently urges that knife edge 28 against either of the knife edges 17 or 18 of the rotary cutter 4 during the cutting operation.

The covering hood 6 covers the rotary cutter 4, which is received in the concave recess 3a of the angle carrier 3, as well as the stationary cutter 5 so as to prevent injury to the operator and together with the angle carrier 3 defines on one side a gap 33 for receiving the data-bearing tape and defines on the other side a gap 34 for dispensing a length of data-bearing tape which has been severed.

The covering hood 7 is adapted to be snapped into the carrier 3 and together with said carrier and the two end walls 1 and 2 defines a closed motor chamber, which accommodates the electric motor 12, the associated transmission 13 and the change-over switch 8 so that said parts are protected against an ingress of dirt and dust and other foreign matter from the chamber which accommodates the cutters and a manual contact with said parts is also prevented.

When the electric motor 12 is started by means of a start pulse, that motor 12 will rotate by means of the multi-stage transmission 13 and the gear 22 the double-edged rotary cutter 4 so that its knife edge 17 moves toward the knife edge 28 of the spring-biased stationary cutter 5. At the same time, the follower lever 9 is forced out of the notch 35 of the cam wheel 21 so as to actuate the change-over switch 8. Owing to a suitable wiring, a voltage will then be applied to the electric motor 12. The data-bearing tape to be severed extends between the knife edge 17 of the double-edged rotary cutter 4 and the knife edge 28 of the spring-biased stationary knife 5 and is severed as the rotation of the double-edged rotary cutter 4 is continued. The operation will begin as soon as the knife edge 17 of the double-edged rotary cutter 4 has reached the knife edge 28 of the spring-urged stationary cutter 5 and will be terminated when the double-edged rotary cutter has continued its rotation by an angle $\beta$. As the rotation of the double-edged rotary cutter 4 is continued, the second notch 36 of the camwheel 21 receives the follower lever 9 so that the change-over switch 8 returns to its initial position, in which the energization of the electric motor is interrupted and that motor 12 is stopped. The double-edged rotary cutter 4 has now performed one-half of a revolution and because its knife edges 17 and 18 are symmetrically arranged the rotary cutter is now in the same initial position as before.

In the next following severing operation the cut will be effected by the second knife edge 18 of the double-edged rotary cutter 4 and the double-edged rotary cutter 4 will again perform one-half of a revolution. Two advantages are afforded by the fact that two knife edges 17 and 18 are used in alternation: In the first place, the service life of the rotary cutter will virtually be doubled and in the second place the time required for each severing cycle will be divided by two for a given motor and transmission.

I claim:

1. In an apparatus for severing data-bearing tapes, comprising, a helical rotary cutter, a stationary cutter for cooperating with said rotary cutter to sever said tape, spring means for urging said stationary cutter against said rotary cutter, and an electric motor for rotating said rotary cutter, the improvement residing in that an angle-section carrier having first and second legs is provided, said first leg is provided with a concave recess extending longitudinally along said carrier, means for mounting said rotary cutter in said recess, said electric motor being mounted on said second leg, a first covering hood is mounted on said carrier and covers said rotary and stationary cutters, a second covering hood is mounted on said carrier and covers said electric motor, and said means for mounting said rotary cutter includes a pair of spaced end walls, each of said end walls is provided with at least one pin for retaining said first covering hood.

2. The improvement set forth in claim 1, wherein said first covering hood defines with said carrier a cutter chamber containing said rotary and stationary cutters, and said second covering hood defines with said carrier a motor chamber, which accommodates said motor and is entirely separated from said cutter chamber.

3. The improvement set forth in claim 2, wherein said motor chamber contains a transmission operatively connecting said motor to said rotary cutter and also contains a control device for controlling the energization of said motor in response to the rotation of said rotary cutter.

4. The improvement set forth in claim 1, wherein said first covering hood has spaced-apart first and second longitudinal side edges, said first side edge defines with a portion of said carrier a first gap for receiving a tape to be severed and said second side edge defines with a portion of the second covering hood, a second gap for dispensing a length of tape which has been severed.

5. The improvement set forth in claim 1, wherein a transmission operatively connecting said electric motor to said rotary cutter is disposed between said electric motor and one of said end walls and has a shaft which is rotatably mounted in said one end wall, said rotary cutter is rotatably mounted between both end walls.

6. The improvement set forth in claim 5, wherein the other of said end walls is screw-connected to said carrier and is spaced from said electric motor, and a control device, responsive to the rotation of said rotary cutter, is mounted on said other end wall.

7. The improvement set forth in claim 1, wherein said carrier, said rotary cutter, said fixed cutter and said recess extending longitudinally between the spaced end walls and are spaced from said electric motor, said spaced end walls include first and second end walls, the first end wall is screw-connected to said carrier and is spaced from said electric motor in direction, a transmission operatively connecting said electric motor to said rotary cutter is disposed between said electric motor and said first end wall and has a shaft which is rotatably mounted in said first end wall, the second end wall is screw-connected to said carrier and is spaced from said electric motor in a second longitudinal direction, opposite of said first direction and a control device, responsive to the rotation of said rotary cutter, is mounted on said second end wall.

8. The improvement set forth in claim 7, wherein said control device comprises a control line connected to said electric motor, a switch connected to said control line and a follower lever for controlling said switch in response to the rotation of said rotary cutter.

9. The improvement set forth in claim 8, wherein said stationary cutter is adjustable end a pin mounted on an eccentric for adjusting the angular orientation of said stationary cutter relative to said rotary cutter is mounted on said second end wall.

10. The improvement set forth in claim 7, wherein a split pin is mounted on one of said end walls and said spring means comprise a torsion spring connected to said split pin and to said stationary cutter.

11. The improvement set forth in claim 1 as applied to a severing apparatus which is adapted to be fixed to a carrying structure, wherein said carrier is formed on its underside with a T-section longitudinal groove for slidably receiving nuts for fixing said carrier to said carrying structure.

12. The improvement set forth in claim 11 as applied to a severing apparatus which is adapted to be associated with a structure having a guiding surface for guiding a length of tape which has been severed, said first leg is formed with a beveled longitudinal edge face which faces away from said second leg, said edge face defines a portion of a receiving gap for receiving a length of tape which has been fed thereto, and said carrier is adapted to be secured to said carrying structure to receive said tape.

13. The improvement set forth in claim 1, wherein said rotary cutter consists of a steel bar which has two helical knife edges, first and second stub shafts are carried by said rotary cutter and extend therefrom in first and second directions, respectively, a gear is non-rotatably connected to said first stub shaft, a transmission is provided for operatively connecting said electric motor to said gear, and a guiding ring and a camwheel for actuating a switch controlling the energization of said motor in response to the rotation of said rotary cutter are mounted on said second stub shaft.

14. The improvement set forth in claim 1, wherein said rotary cutter comprises first and second knife edges, said stationary cutter is adjustably mounted and defines a stationary knife edge for cooperating with said first and second knife edges, one end of said stationary cutter is supported by a retaining pin mounted on an eccentric rotatably mounted in one of said end walls, said spring means comprise a torsion spring, which is connected to the other end of said stationary cutter supported by another retaining pin mounted in said other of said end walls, and said eccentric is rotatable to adjust by means of said torsion spring said stationary cutter to a position in which said stationary knife edge has a desired angular orientation relative to said first and second knife edges.

* * * * *